US010156424B2

(12) United States Patent
Williams et al.

(10) Patent No.: US 10,156,424 B2
(45) Date of Patent: Dec. 18, 2018

(54) IRON SIGHT SYSTEM FOR HANDGUNS INCLUDING A NOTCHED BLADE REAR IRON SIGHT WITH VIEW WINDOWS

(71) Applicants: Dwight P. Williams, Vidor, TX (US); Kenneth W. Lloyd, Beaumont, TX (US)

(72) Inventors: Dwight P. Williams, Vidor, TX (US); Kenneth W. Lloyd, Beaumont, TX (US)

( * ) Notice: Subject to any disclaimer, the term of this patent is extended or adjusted under 35 U.S.C. 154(b) by 14 days.

(21) Appl. No.: 15/228,238

(22) Filed: Aug. 4, 2016

(65) Prior Publication Data

US 2017/0138696 A1 May 18, 2017

Related U.S. Application Data

(63) Continuation of application No. 62/209,479, filed on Aug. 25, 2015.

(51) Int. Cl.

| | |
|---|---|
| ***F41G 1/10*** | (2006.01) |
| ***F41G 1/12*** | (2006.01) |
| ***F41G 1/08*** | (2006.01) |
| ***F41G 1/26*** | (2006.01) |
| ***F41G 1/02*** | (2006.01) |

(52) U.S. Cl.

CPC ..... *F41G 1/10* (2013.01); *F41G 1/02* (2013.01); *F41G 1/08* (2013.01); *F41G 1/26* (2013.01)

(58) Field of Classification Search

CPC ..... F41G 1/06; F41G 1/08; F41G 1/10; F41G 1/12; F41G 1/423; F41G 1/42; F41G 1/425; F41G 1/01

USPC ..... 42/133

See application file for complete search history.

(56) References Cited

U.S. PATENT DOCUMENTS

| | | | | | |
|---|---|---|---|---|---|
| 1,363,553 | A | * | 12/1920 | Barringer | F41G 1/12 42/145 |
| 1,406,620 | A | * | 2/1922 | Dear | F41G 1/01 42/142 |
| 2,246,174 | A | * | 6/1941 | Howells | F41G 1/32 42/145 |
| 2,566,590 | A | * | 9/1951 | Trippi | F41G 1/473 42/144 |
| 5,327,654 | A | * | 7/1994 | Parker | F41G 1/01 42/136 |
| 5,822,872 | A | * | 10/1998 | Waki | F41G 1/12 42/111 |
| 5,887,352 | A | * | 3/1999 | Kim | F41G 1/01 42/144 |
| D435,283 | S | * | 12/2000 | Ling, Jr. | D22/108 |
| D492,747 | S | * | 7/2004 | LoRocco | D22/109 |

(Continued)

OTHER PUBLICATIONS

New England Custom Gun Service, Ltd. "See-Thru" Fiber Optic Rear Sight Insert http://www.newenglandcustomgun.com/Gun_Services/item_info.asp?Brand_id=6177&ST=%22See-Thru%22%20Fiber%20Optic%20Rear%20Sight%20Insert#.V5vfsfmAOko.

(Continued)

*Primary Examiner* — Derrick R Morgan
(74) *Attorney, Agent, or Firm* — Cullen Kiker

(57) ABSTRACT

An iron sight system for handguns including a notched blade rear iron sight, providing view windows through blade structure predominantly to the left and to the right of a defined notch, and the notched blade rear iron sight combined with a front iron sight providing a view therethrough.

8 Claims, 7 Drawing Sheets

(56) References Cited

U.S. PATENT DOCUMENTS

| | | | | |
|---|---|---|---|---|
| 7,451,566 | B1 * | 11/2008 | Price | F41G 1/01 42/111 |
| 7,743,546 | B2 * | 6/2010 | Keng | F41G 11/003 42/113 |
| 7,934,334 | B2 * | 5/2011 | Kraft | F41G 1/01 42/111 |
| D667,524 | S * | 9/2012 | Glimpse | D22/109 |
| D667,525 | S * | 9/2012 | Glimpse | D22/109 |
| 8,261,481 | B1 * | 9/2012 | Shebaro | F41G 1/12 42/113 |
| 8,863,433 | B2 * | 10/2014 | Kruse | F41G 1/01 42/111 |
| 8,919,027 | B2 * | 12/2014 | Curry | F41G 1/00 42/133 |
| 9,322,614 | B2 * | 4/2016 | Williams | F41G 1/02 |
| 9,328,993 | B1 * | 5/2016 | Heacock | F41G 1/02 |
| 9,658,030 | B1 * | 5/2017 | Heacock | F41G 1/01 |
| D801,468 | S * | 10/2017 | Kedairy | D22/109 |
| 2014/0338246 | A1 * | 11/2014 | Crum | F41G 1/02 42/111 |
| 2015/0226520 | A1 * | 8/2015 | Williams | F41G 1/02 42/111 |
| 2015/0345902 | A1 * | 12/2015 | Abrams | F41G 1/01 42/111 |
| 2017/0254618 | A1 * | 9/2017 | Kedairy | F41G 1/01 |

OTHER PUBLICATIONS

New England Custom Gun Service, Ltd. Sights http://www.newenglandcustomgun.com/Gun_Services/Sights.asp.

Barsness, John The Optic of Iron: Traditional Rifle Sights Use Neither Lenses Not Batteries, But Obey Similar Physical Laws. Guns Magazine, Dec. 2015, pp. 18-19, vol. 61, No. 12, 732$^{nd}$ Issue, Publisher's Development Corporation, San Diego, CA.

* cited by examiner

FIG.3
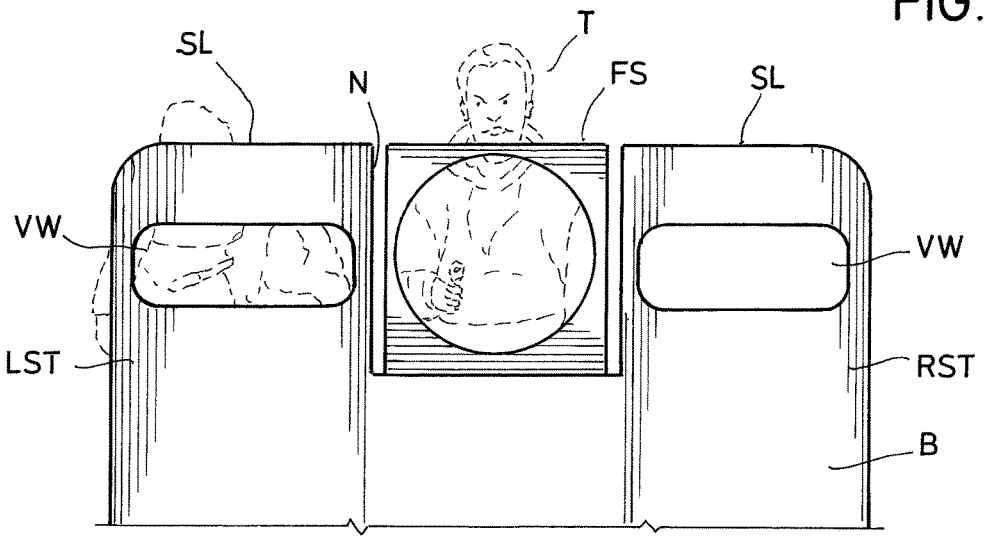
FIG.4
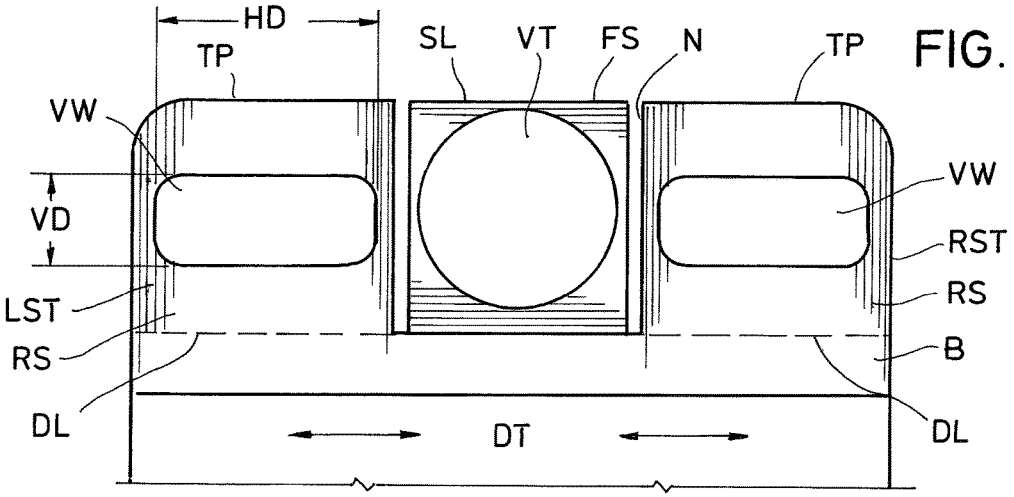
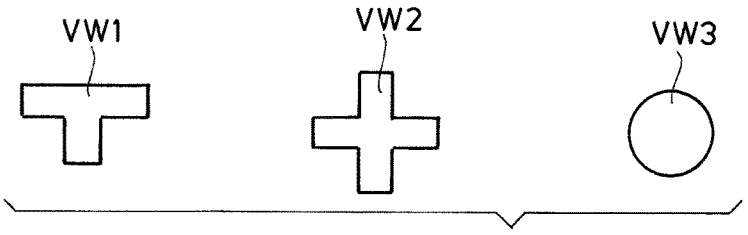
FIG.5

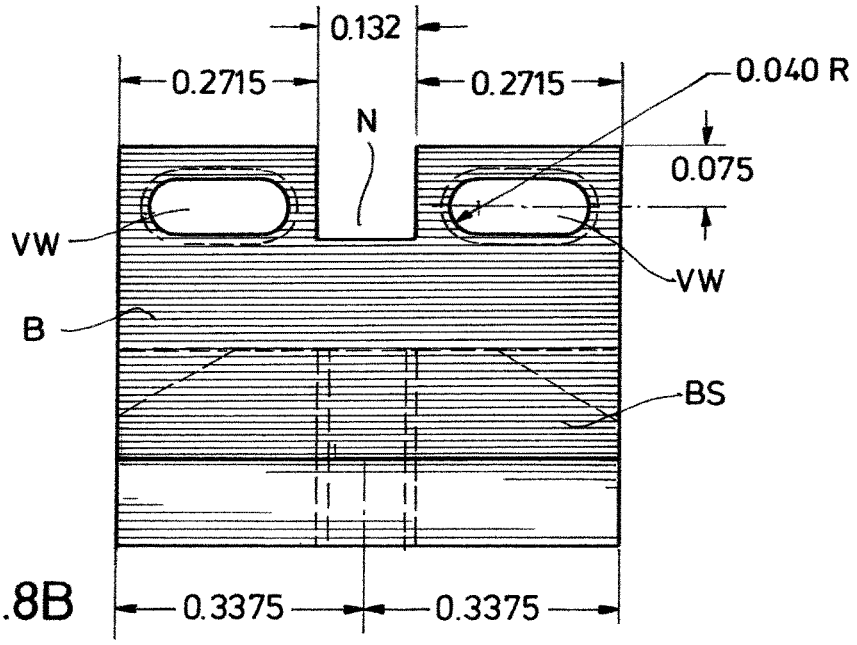
FIG.8B
FIG.8D
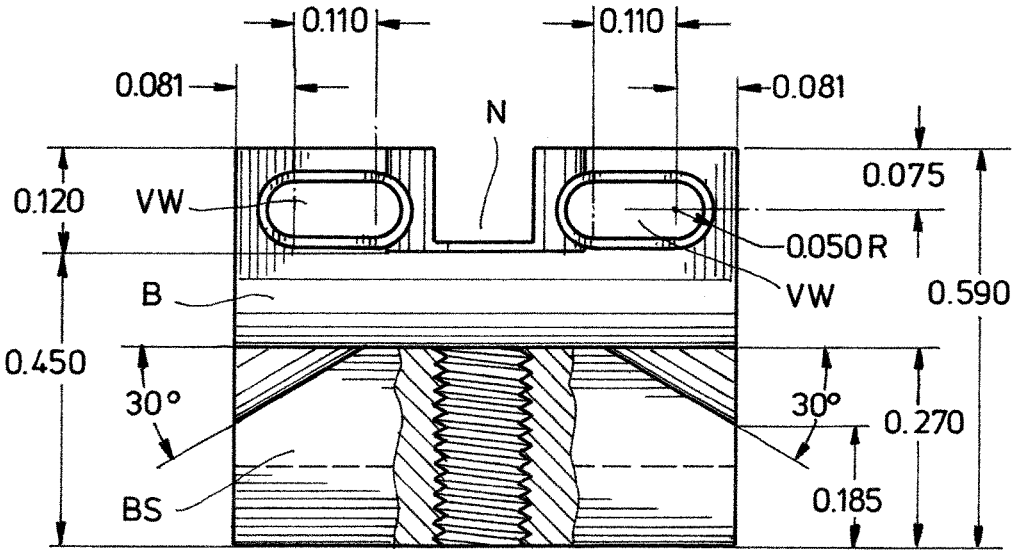

IRON SIGHT SYSTEM FOR HANDGUNS INCLUDING A NOTCHED BLADE REAR IRON SIGHT WITH VIEW WINDOWS

This application relates to and claims priority to the provisional application Ser. No. 62/209,479, filed Aug. 25, 2015, entitled A Notched Rear Iron Sight With Windows, having inventors Dwight P. Williams and Kenneth W. Lloyd. The contents of the referenced provisional application are herein and hereby incorporated by reference in their entirety.

FIELD OF INVENTION

The field of the invention lies in iron sight systems for handguns and includes a notched blade rear iron sight with view windows.

BACKGROUND OF INVENTION

Applicants have been issued U.S. Pat. No. 9,322,614, for a front iron sight for a firearm, the front iron sight providing a view of a target therethrough. That patent, with inventors Dwight P. Williams and Kenneth W. Lloyd, is herein and hereby incorporated by reference in its entirety.

Applicants have now invented an improved iron sight system including a notched blade rear iron sight with view windows. The rear sight is particularly useful when combined with the above referenced front iron sight on a handgun.

A handgun includes pistols and revolvers. "Blade" is a term used for a type of rear iron sight that presents a leading surface to the shooter comprising a relatively upstanding wall section, the blade mounted to a gun via a base mechanism such as a dovetail which can be integrated into the blade. The "blade" may be relatively thick and rugged and present a corrugated leading surface to improve management of light, definition and contrast. Notches are known to come in a variety of shapes.

An issue with current notched blade rear iron sights for handguns is that the blade structure located to the left of and to the right of the defined notch, which blade structure assists in aligning a front sight in the notch, nonetheless obscures a portion of the target from the view of the shooter. This obscured view could include an important portion of the target area. As illustrated by FIGS. 1-3, a shooter is best appraised of what is going on to the left of and to the right of a target while maintaining a sight of a handgun on the target. At 100 yards a rear blade sight on a handgun often covers up 8-11.6 feet of target area. See FIG. 2. As FIG. 2 indicates it may be important for a shooter, in order to prevent mistakes of commission or omission, to see on each side of a target in order to look for additional threats or out of consideration for the safety of others.

A second issue is securing a clear definition of the notch to the viewer in various ambient light situations. The instant view windows situated in the blade structure to the left and right of the notch can provide that visibility for a handgun, as well as enhance the definition of the notch, without sacrificing other benefits of a blade structure. In addition to increasing target area visibility for a shooter, testing has surprisingly shown that view windows to the left and to the right of a notch in a blade of a rear handgun iron sight assist in, and speed, a centering of a front sight within the notch. Testing shows that properly designed rear iron sight view windows provide for a quicker response on a target. See FIG. 4. And, the view windows further aid in range finding. See FIGS. 6D and 6E.

Applicant's preferred embodiments feature horizontal view windows, view windows extending predominantly laterally on each side of a notch. Such have been shown to enhance notch definition and assist quick accurate alignment with a front iron sight. Differently shaped view windows could be used. See FIG. 5.

A rear iron sight with a small notch and large flared windows to the left, right and downward of the notch has been known for rifles. (See material presented in information disclosure document.) No similar iron sight is known by the instant inventors to be provided for handguns. In contrast, applicant's notched blade rear iron sight provides view windows located predominantly in blade structure to the left and to the right of the defined notch, and preferably provides a view window area of a size between two to five times that of a notch view area. The leading side of applicant's blade preferably provides a top portion defining a straight sightline across, and to the left and to the right of, the notch, for more accurate alignment of the notch with a handgun front sight. Applicant's rear iron sight also preferably provides view windows that occupy only between 40% and 80% of the leading side blade structure to the left and to the right of the notch, thereby providing sufficient remaining blade structure to assist in accurately aligning a notch with a front sight. Further, the view windows of applicant's rear iron sight preferably provide a horizontal viewing dimension greater than a vertical viewing dimension through the blade structure.

Preferably also, to maximize target area viewing and definition of a front sight in a rear notch, the rear iron sight is combined with a front sight that is also structured to provide a view of a target therethrough. Proper sight alignment has been shown to be enhanced by aligning a front sight view window with horizontally aligned left and right blade view windows.

SUMMARY OF THE INVENTION

The invention comprises an iron sight system for handguns including a notched blade rear iron sight structured to be mounted, such as by a dovetail, in a rear iron sight position on a handgun. A notch defined by the blade in blade structure is sized for visual alignment with a front iron sight. View windows are defined in blade structure predominantly located to the left and to the right of the notch, the view windows occupying at least 10% of that portion of the blade structure. Preferably a top portion of a leading surface of the blade indicates a straight sightline across, and at least somewhat to the left and to the right of, the notch, for improved alignment of the notch with a front sight. Preferably, also with the blade oriented in an upright position, the view windows of a leading side of the blade provide a horizontal dimension greater than a vertical dimension.

Preferably the view windows afford a view through the blade structure of between 4 to 10 times the size of the view provided through the notch, and preferably the view windows occupy approximately 40% to 80% of the leading side blade structure located to the left and to the right of the notch. Preferably also the blade defines a notch having substantially straight upper vertical sides. And preferably the area of the view windows and of the notch widens from the leading side of the blade structure to the trailing side of the blade structure.

The invention includes an iron sight system for handguns comprising a front iron sight structured for location at a front end of a handgun, providing a view of a target therethrough, together with a notched blade rear iron sight structured for location on a rear end of the handgun and providing view windows in the structure of the blade, the view windows located predominantly to the left and to the right of a notch defined by the blade.

BRIEF DESCRIPTION OF THE DRAWINGS

A better understanding of the present invention can be obtained when the following detailed description of the preferred embodiments are considered in conjunction with the following drawings, in which:

FIG. 3 illustrates, by contrast with FIG. 2, top portions of a notched blade rear iron sight, leading side view, aligned with a front iron sight wherein the front iron sight provides a view therethrough and the structure to the left and to the right of the notch of the rear iron sight provides view windows therethrough. Important target information is shown revealed. Straight top portions of the leading side of the blade assist alignment of the front sight with the notch, as to the horizontally shaped rear sight view windows.

FIG. 4 illustrates top portions a notched blade rear iron sight, leading side view, aligned with a front sight, the rear sight providing view windows on both sides of the notch and the front sight providing a view therethrough. Blade structure to the left and to the right of the notch is indicated by a dashed line defining the bottom of such blade structure.

FIG. 5 illustrates an assortment of possible options for possible shapes for view windows.

FIG. 6C also illustrates a potential benefit of view windows as a range finder.

FIGS. 8A-8D are not drawn to scale but offer dimensions of a preferred embodiment of the notched blade rear iron sight giving views from the top side, the leading side, the side and the trailing side.

The drawings are primarily illustrative. It would be understood that structure may have been simplified and details omitted in order to convey certain aspects of the invention. Scale may be sacrificed to clarity.

DETAILED DESCRIPTION OF PREFERRED EMBODIMENT

An improved iron sight system for a handgun, including a notched blade rear iron sight, is illustrated in FIGS. 1, 3, 4, 6A-6D, 7A, 7B, 8A-D and 9A and 9B. The notched blade rear iron sight is referred to as rear sight RS. FIGS. 4, 7A, 7B, 8A-8D and 9A and 9B illustrate the rear sight RS with a blade B created in one piece with dovetail DT used as a mounting platform, as is known in the art. Such unitary construction is convenient but not necessary.

FIG. 4 illustrates, by using dashed lines DL to indicate the bottom boundary, blade structure called RST, to the right of notch N, and blade structure called LST, to the left of notch N. FIG. 4 further illustrates a right view window VW and a left view window VW in a notched blade B the windows located to the left and to the right of the notch, and further illustrate a front sight FS that provides a view VT through the front sight of a target T.

In the illustrated embodiments it is assumed that an alignment of the sights for the handgun is with the top of the front sight aligned with the top of the blade of the rear sight. A straight top portion TP of the blade B on both sides of the notch N create a useful imaginary straight line (SL FIG. 4) for at least a portion of the blade to the left and to the right of the notch, to assist in a rapid and accurate alignment of the sights. FIG. 7B illustrates an alternate alignment of a front sight with a rear sight, which is useful for longer distance shooting. The imaginary straight line created by the blade over the notch assists in making that alignment also.

Figure 1:
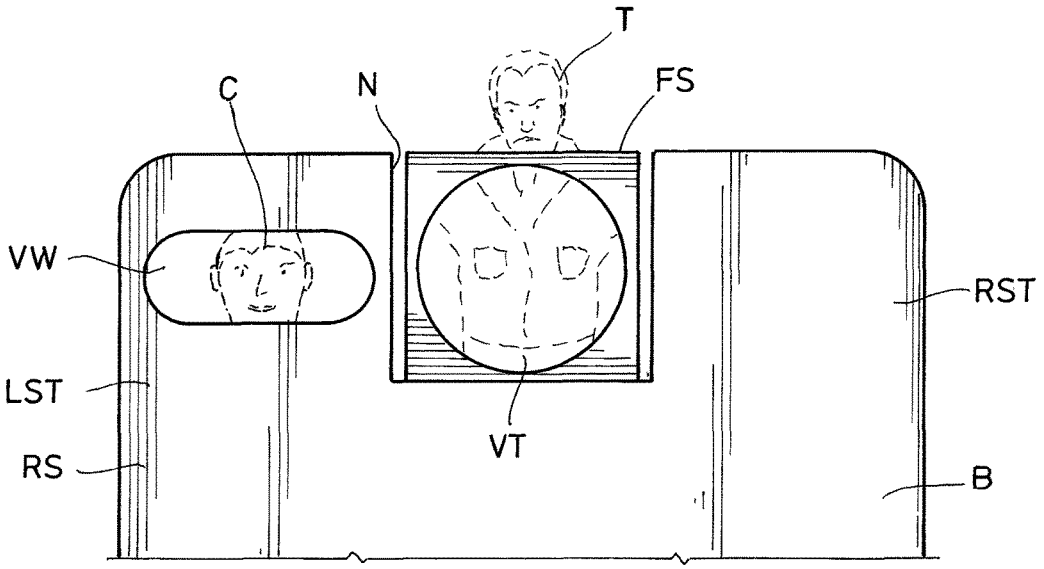
FIG. 1 illustrates top portions, leading side view, of a notched blade rear iron sight having a notch aligned with a front sight, the front sight having a view window therethrough, the rear sight shown having a view window through the blade left side structure, the rear sight and the front sight being shown aligned on a target.

More particularly, FIG. 1 illustrates a notched blade rear iron sight RS centered on a target T and having a left view window VW. The left window VW is in the structure LST of the blade to the left of the notch N. FIG. 1 further illustrates the possibility of a child C or a kneeling shooter being to the left side of target T. Knowledge of the presence of the child or an adversary would affect a shooter's decisions. (In FIG. 1 target T is assumed to be at a significant distance from the handgun so that to hit a proper point on the target with the selected sight alignment, the handgun is aimed at about the target's chin.)

Figure 2:
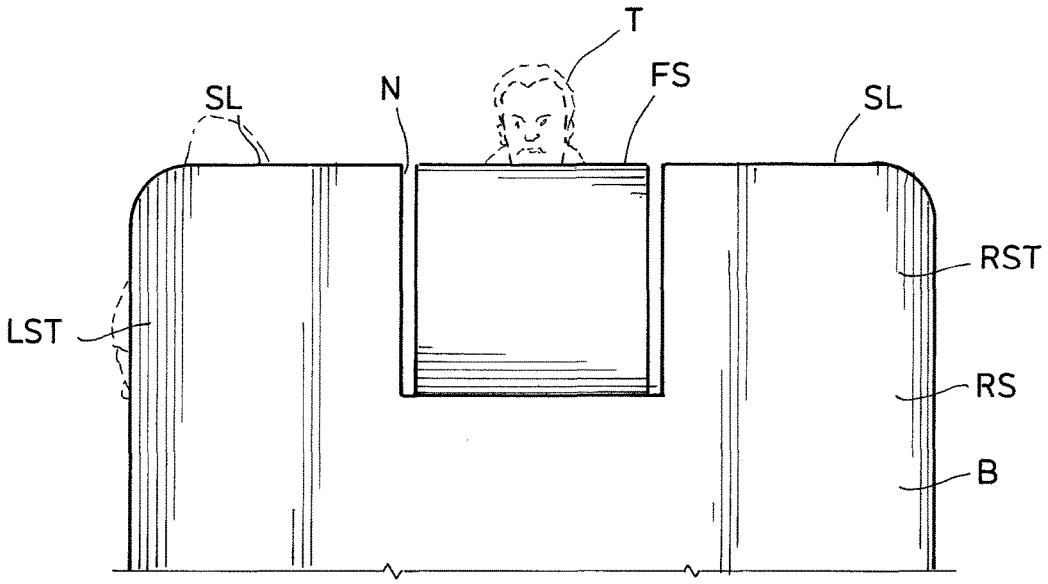
FIG. 2 (PRIOR ART)
FIG. 2 illustrates top portions, leading side view, of a notched blade rear iron sight aligned with a front iron sight wherein neither the front iron sight nor the rear sight provide a view therethrough, thereby suggesting that important views of a target area are obscured.

FIGS. 2 and 3 illustrate in combination the value of a view through a front sight as well as the value of a view through windows to the left and to the right of a notch N in a blade rear sight RS. The possibility of assessing danger to self and others by a shooter, the importance of not being "blind-sighted," can be crucial in making decisions. The information available through the left blade view window VW of FIG. 3 and the view window VT of the front sight FS seen through the notch N is clearly important.

FIG. 4 illustrates the combination of a rear notched blade iron sight RS having a blade B and having a dovetail DT mounting platform for affixing to a handgun, the blade and mounting all in one piece. The view windows VW in FIG. 4 occupy less of the blade structure to the left and to the right of the notch than the view window of FIG. 1 and FIG. 3. Preferably the view windows afford a view through at least approximately 10% of the blade structure located to the left and to the right of the notch (LST, RST) (again, such blade structure to the left and to the right of the notch considered to be bordered on the bottom by the dashed line DL indicated in FIG. 4.) Preferred view windows would afford a view through approximately 40% to 80% of the blade structure located to the left and to the right of the notch (LST and RST.) A view window of approximately 4 to 10 times the area of the notch defined by the blade structure may be preferable. The shape of a view window is not necessarily rectangular, but providing a horizontal dimension HD greater than a vertical dimension VD (notch and blade oriented in upright position up) is preferred.

FIG. 5 illustrates a variety of shapes (VW1, VW2, VW3) that could be used for view windows. Again, to aid alignment and provide definition to the notch, two view windows are preferably generally horizontal and each of an area of between 2 to 5 times the area defined by the notch. The horizontal view windows VW, such as in FIG. 4, have been found to be particularly valuable as an aid in centering a front sight FS quickly in a notch to acquire a target T.

Certain tests were conducted using the instant invention installed on a 1911 pistol with a 5" barrel. See FIGS. 6A-6E. At 25 yards, a notched blade rear iron sight covered up a width of approximately 35" on a target, taking into account both sides of the rear sight, the front sight, and a thin gap seen on each side of the front sight between the rear sight notch. By combining two 10" covering view windows VW with a 5" covering front sight aperture VT, see FIG. 6A, a shooter gains an additional 25" of visible sight area upon a target 25 yard away, sight area that would not be available to a shooter using conventional solid sight systems*. At 50 yards, FIG. 6B, the instant windowed sight system approximately doubles the visible target sight area from that available at 25 yards. For a 50 yard distance target the shooter has approximately 49" of visible sight area available, area which would normally be obstructed using conventional solid sight systems*. At a target distance of 100 yards, FIG. 6C, the visible sight area once again approximately doubles from that available at 50 yards. The shooter has approximately 100" of visible sight area available through the windows, area which would normally be obstructed using conventional solid sight systems*.

*Measurements may vary slightly depending on eye to sight distance. Illustration dimensions not to scale.

As an additional advantage the instant view windows can be used as a range finder. See FIG. 6C. When looking at the 100 yard example, since the average distance from an adult's belt to the top of their head is 30", a shooter could know, through viewing through the view windows and calibrating mentally, that a target is approximately 100 yards away.

Figure 6A:
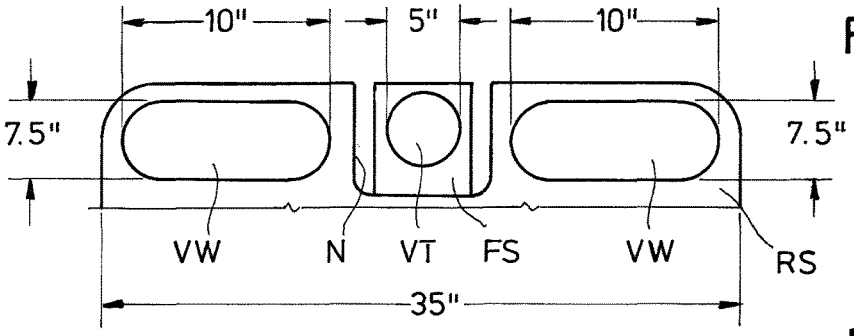
FIGS. 6A, 6B and 6C illustrate variations in widths of view of a target area, at various target distances, observable through a notched blade rear iron sight together with front iron sight, both with view windows. The target distances are 25 yards, 50 yards and 100 yards and illustrate a benefit of view windows.
Figure 6B:
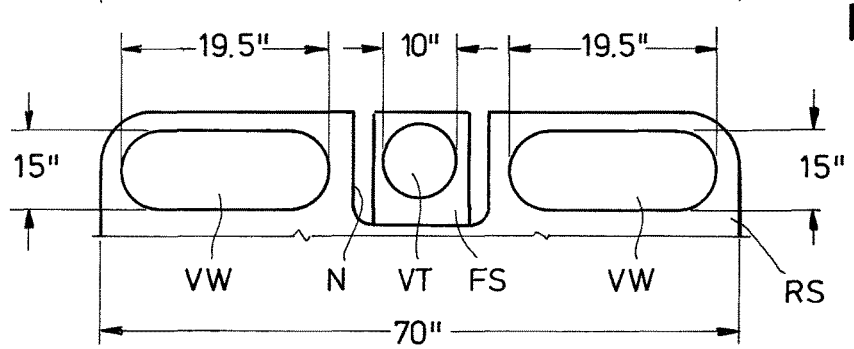
Figure 6C:
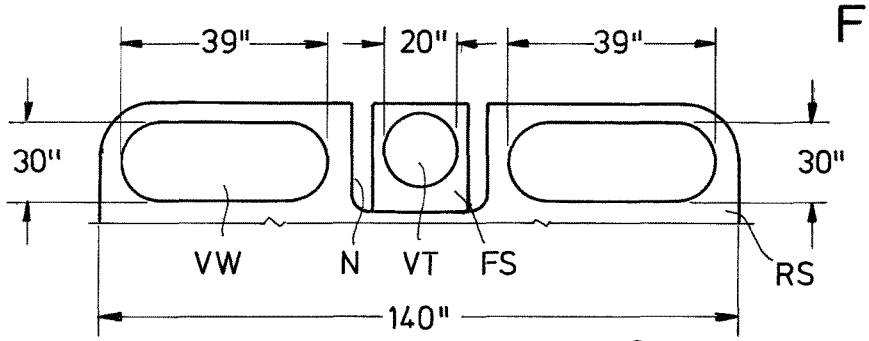
Figure 6D:
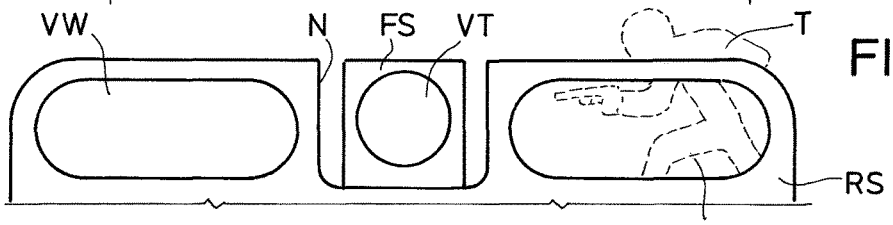
FIGS. 6D and 6E illustrate how rear iron sight view windows can also facilitate a shooter to better lead a moving target.

The instant invention also allows the shooter to determine moving targets (FIG. 6D versus FIG. 6E) and to better lead moving targets, as shown in FIG. 6D. When swinging a sight picture past a moving target, a shooter can make the shot once the target is in the middle of a view window (based on the average human running speed).

Sharp square cuts on top portion of the blade leading side, as well as on the front sight, as illustrated in FIGS. 6A-6D, have been found to allow quicker more precise sight picture alignment, making accuracy more likely.

Figure 6E:
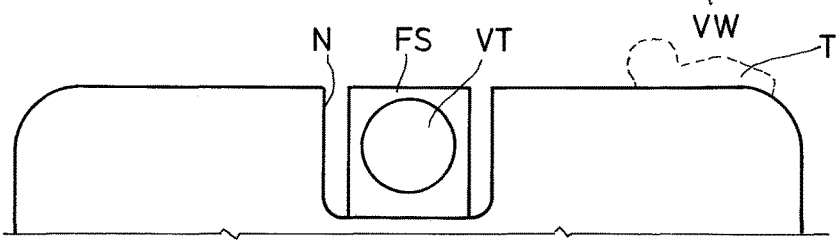

Further with regard to FIG. 6E, with the view windows a shooter sees where they are shooting as well as what is going on in and around the target area. This is not the case with conventional solid rear sight systems, such as in FIG. 6E, where the shooter is only aware of what they can see around the rear sight.

Figure 7A:
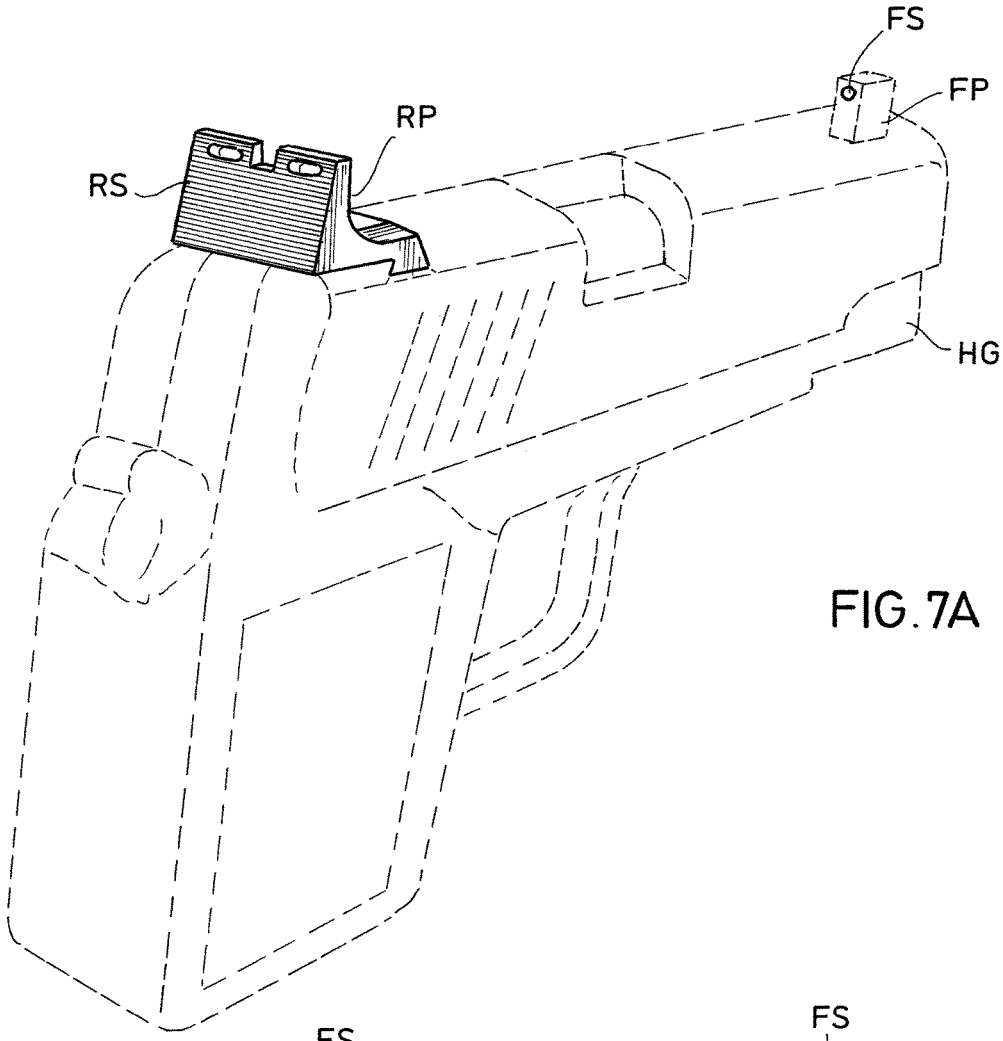
FIG. 7A illustrates a notched blade rear iron sight with view windows as mounted on a rear position of a handgun.
Figure 7B:
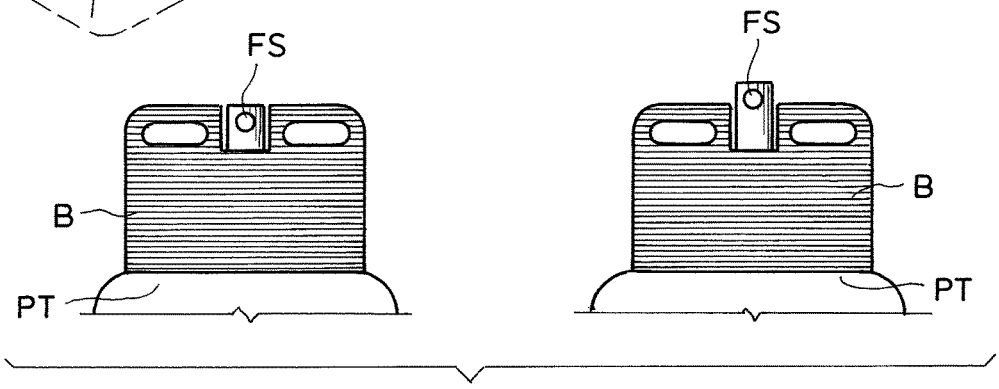
FIG. 7B provides two close ups of the rear iron sight of FIG. 7A, leading side view, illustrating two different positionings of a front sight within the notch of a rear sight, which positioning is assisted by the indication of a straight sightline (provided by rear sight top portions and by the horizontally oriented rear sight view windows together with a front sight view window) by the top portions of the blade, over the notch and to the left and to the right of the notch as well. Positioning of the front sight in the notch is also assisted by the extra defining of the notch rendered by the left and right view windows.

FIGS. 7, 8 and 9 provide a more three-dimensional perspective on the instant iron sight system including the notched blade rear iron sight. FIG. 7A illustrates a rear sight RS mounted at a rear position RP on handgun HG and a front sight FS mounted in a front position FP on the handgun. FIG. 7B offers a shooter's view of the leading side of a rear sight RS in FIG. 7A. The blade portion and the dovetail portion of the rear sight RS can be seen as well as the front sight FS providing a view therethrough, the front sight FS shown aligned in two different positions in the notch of the rear sight, indicating two different target distances.

Figure 8A:
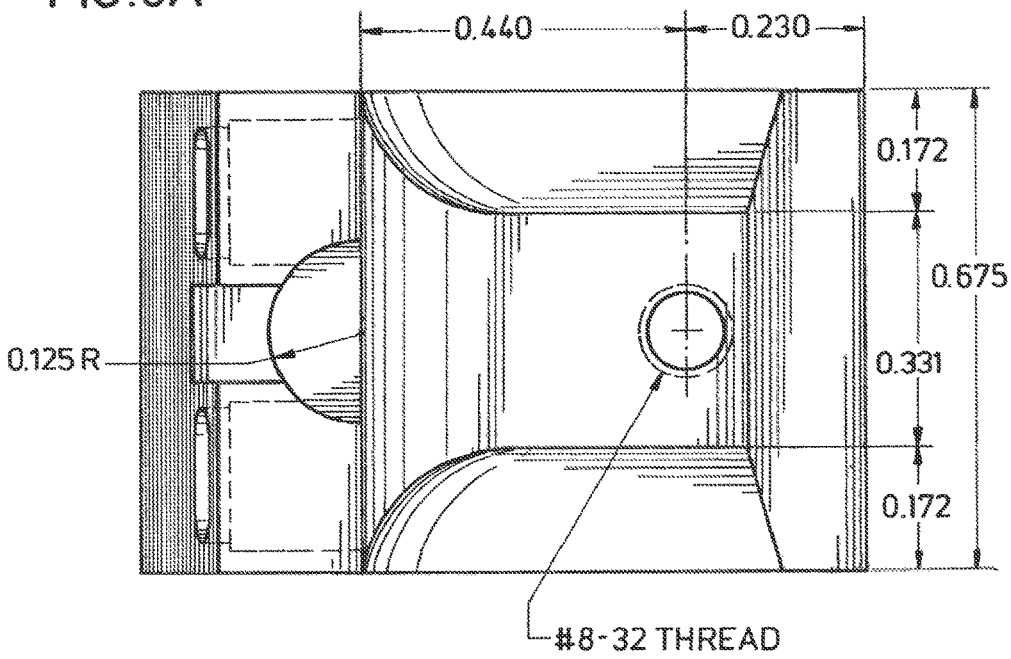
Figure 8C:
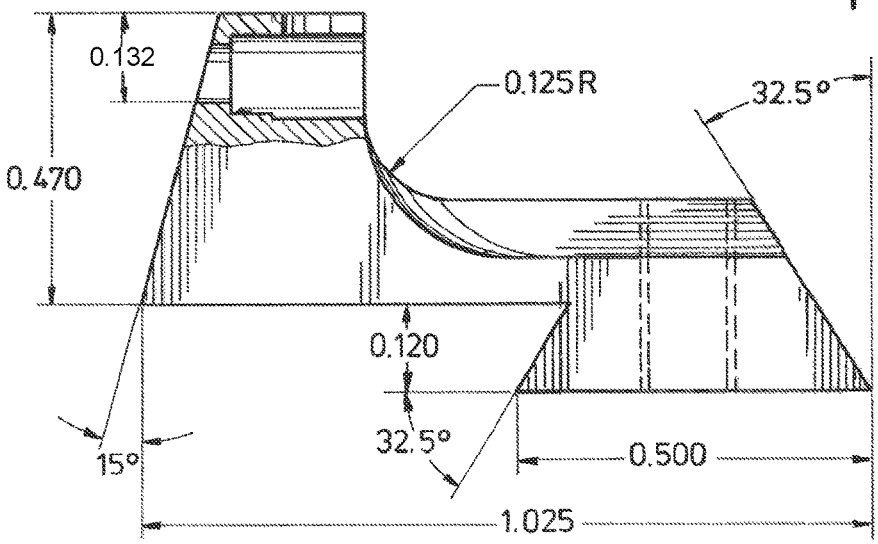

FIGS. 8A-8D illustrate a top, leading side, side and trailing side view of a preferred embodiment. The drawings are not to scale but the dimensions reflect that of one preferred embodiment. It can be seen in FIGS. 8B and 8D that the notch and the view windows are routed out, or widened, through the thickness of the blade from the leading side of the blade toward the trailing side of the blade. FIG. 8C side view illustrates the thickness of the blade, beneficial for reinforcement.

It is known in the art, from the leading side to the trailing side of a blade of a notched rear iron sight, across the thickness of the blade, the notch outer walls are typically widened. Top portions of the blade are also removed toward the trailing side of the blade. The widening and the removal of top portions helps give visual definition to the shooter of the walls of the notch on the leading side. Preferably the walls of the view window are also widened from the leading side to the trailing side. As a result typically the material between the notch outer wall and the view window inner wall will in fact be eliminated with the widening. Material over the top portion of the blade toward to the trailing side of the blade will also preferably be removed to further add visual definition to the outline of the notch and to the windows on the leading side of the blade.

Figure 9A:
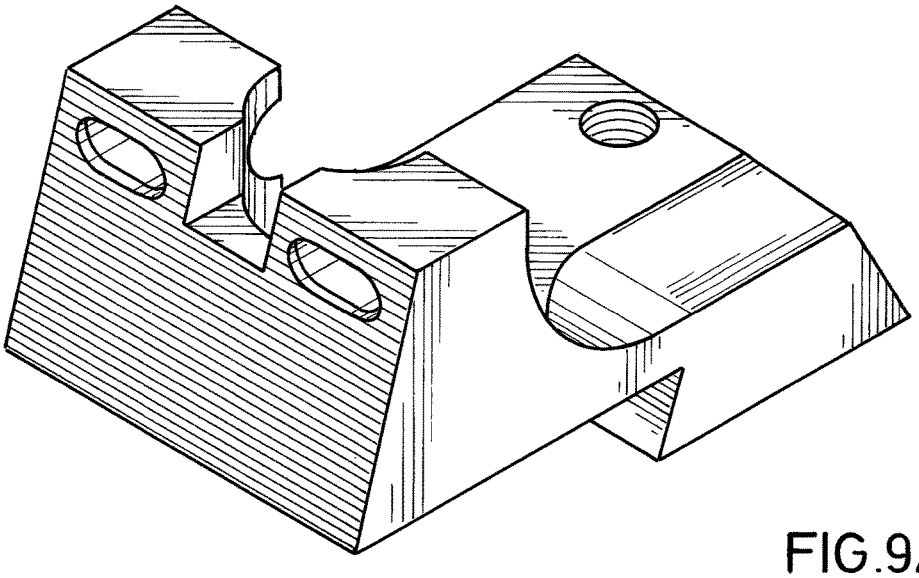
FIGS. 9A and 9B offer perspective views of a notched blade rear iron sight embodiment of the type, similar to FIGS. 8A-8D.
Figure 9B:
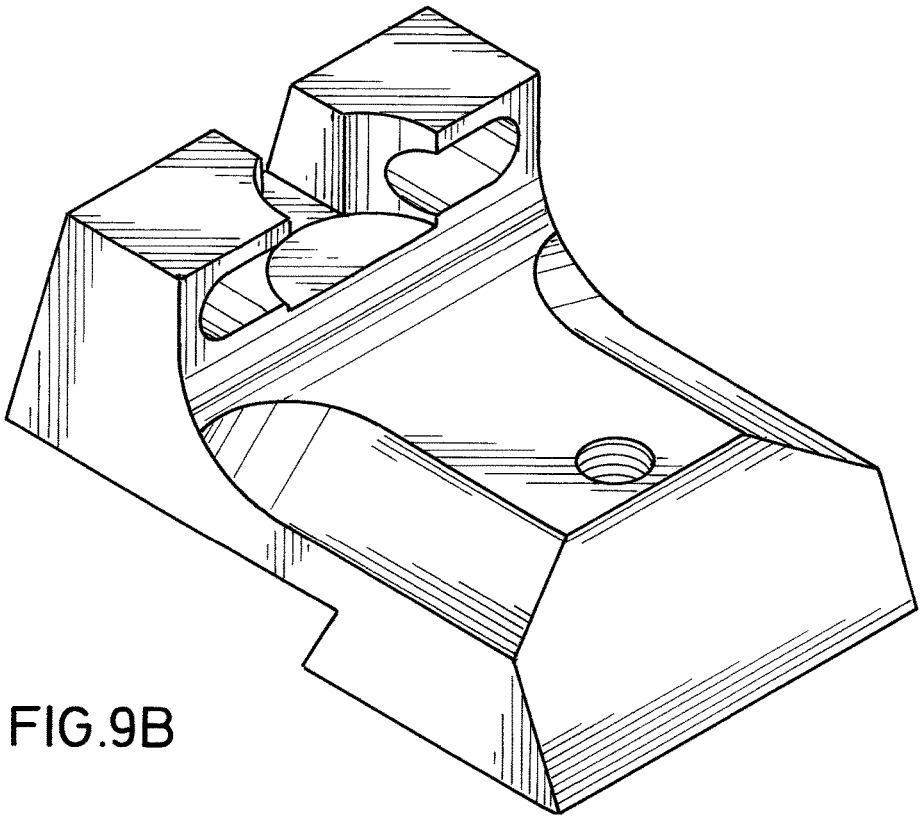

FIGS. 9A and 9B offer a perspective view of one embodiment of the instant rear iron sight with view windows.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A notched blade rear iron sight for handguns, comprising;

a blade structured to be mounted in a rear iron sight position on a handgun, the blade defining a notch for visual alignment with a front iron sight;

the blade providing view windows with a majority of said view windows located above a horizontal surface of the notch and to the left and to the right of the notch in the blade structure, the view windows occupying at least 10% of the blade structure to the left and to the right of the notch; and the blade providing a leading side top portion indicating a straight sightline over, and to the left and to the right of, the notch.

2. A notched blade rear iron sight for handguns, comprising;

a blade structured to be mounted in a rear iron sight position on a handgun, the blade defining a notch for visual alignment with a front iron sight;

the blade providing two view windows with a majority of said view windows located above a horizontal surface of the notch and to the left and to the right of the notch in the blade structure, the view windows occupying at least 10% of the blade structure to the left and to the right of the notch; and with the blade oriented in an upright position, the view windows of a leading side of the blade providing a horizontal dimension greater than a vertical dimension.

3. The notched blade rear iron sight for handguns of claim 1 or 2 wherein the view windows provide a viewing area through a leading side of the blade structure of between 4 to 10 times a view area defined through the leading side by the notch.

4. The rear iron sight of claim 3 wherein the view windows occupy approximately 40% to 70% of the leading side of the blade structure to the left and to the right of the notch.

5. The rear iron sight of claim 3 wherein the leading side of the blade defines a notch with three substantially straight contiguous sides.

6. The rear iron sight of claim 2 wherein the area defined by the view windows and by the notch in the blade structure widens from a leading side to a trailing side of the blade.

7. An iron sight system for handguns comprising the notched blade rear iron sight of claim 1 or 2 and a front iron sight structured for location on a front end of the handgun with the front iron sight providing a view of a target therethrough.

8. The rear iron sight of claim 1 or 2 wherein the view windows are circumscribed by blade structure.

* * * * *